US008229313B2

(12) United States Patent
Oh

(10) Patent No.: US 8,229,313 B2
(45) Date of Patent: Jul. 24, 2012

(54) IMAGE FORMING APPARATUS AND METHOD TO DETECT TONER THEREOF

(75) Inventor: Han Sang Oh, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/887,711

(22) Filed: Sep. 22, 2010

(65) Prior Publication Data

US 2011/0091235 A1 Apr. 21, 2011

(30) Foreign Application Priority Data

Oct. 20, 2009 (KR) ..... 10-2009-99621

(51) Int. Cl.
*G03G 15/00* (2006.01)

(52) U.S. Cl. ..... 399/74

(58) Field of Classification Search ..... 399/29, 399/30, 49, 74
See application file for complete search history.

(56) References Cited

U.S. PATENT DOCUMENTS

| | | | | |
|---|---|---|---|---|
| 4,684,239 | A * | 8/1987 | Takayanagi et al. | 399/47 |
| 4,835,577 | A * | 5/1989 | Fujita et al. | 355/68 |
| 5,206,686 | A * | 4/1993 | Fukui et al. | 399/1 |
| 5,325,153 | A * | 6/1994 | Mitsuse et al. | 399/74 |
| 5,773,827 | A * | 6/1998 | Yazdy et al. | 250/341.8 |
| 6,750,892 | B2 * | 6/2004 | Suzuki | 347/133 |

* cited by examiner

*Primary Examiner* — Kiho Kim
(74) *Attorney, Agent, or Firm* — Stanzione & Kim, LLP

(57) ABSTRACT

An image forming apparatus to detect the toner density of a patch pattern formed on a photosensitive medium or a transfer belt without a deviation in light intensity includes a density sensor including a light emitter to scan light onto at least one patch pattern formed as a toner image and a light receiver to receive light reflected from the at least one patch pattern and convert the received light to an electrical signal, a switch to turn on or off the light emitter, and a controller to maintain light intensity of the light emitter within a reference range by controlling on-time and off-time of the switch.

19 Claims, 11 Drawing Sheets

IMAGE FORMING APPARATUS AND METHOD TO DETECT TONER THEREOF

CROSS-REFERENCE TO RELATED APPLICATIONS

This application claims the benefit of priority under 35 U.S.C. §119 to Korean Patent Application No. 10-2009-0099621, filed on Oct. 20, 2009 in the Korean Intellectual Property Office, the disclosure of which is incorporated herein by reference in its entirety.

BACKGROUND

1. Field of the Invention

Embodiments of the present general inventive concept relate to an image forming apparatus to detect the toner density of a developer and a control method thereof.

2. Description of the Related Art

Generally, an electrophotographic printer prints a black and white image or a color image by scanning light onto a photosensitive medium charged to a predetermined potential, thereby forming an electrostatic latent image, developing the electrostatic latent image with toners of predetermined colors in a developing device, and transferring and fixing the developed image onto a sheet of paper.

Electrophotographic printers are categorized into wet-type electrophotographic printers and dry-type electrophotographic printers according to the types of developers used in them. A wet-type electrophotographic printer uses a developer containing a powder toner scattered in a liquid carrier, whereas a dry-type electrophotographic printer uses a two-component developer containing a powder carrier and a toner, or a single-component developer containing a toner only.

In order to print a full-color image, color toners of yellow (Y), magenta (M), cyan (C), and black (K) are required. Thus, four developing devices are also required, each for developing one of the four color toners. A full-color image can be formed by a single path method using four exposurers and four photosensitive media or by a multi-path method using a single exposurer and a single photosensitive medium.

To get a uniform and good-quality color image, many bias parameters such as a charge voltage, a development voltage, a transfer voltage, etc. should be determined and applied. Density gradation and stability are particularly critical factors to determine image quality in an image forming apparatus that forms overlapped images on a photosensitive medium or an intermediate transfer belt and transfers the overlapped images onto a sheet of paper at a time.

Accordingly, to maintain an accurate density of a color image, a color image forming apparatus using a photosensitive medium or an intermediate transfer belt forms a density measurement patch of a predetermined type on the photosensitive medium or the intermediate transfer belt and determines a plurality of bias parameters by measuring the toner density of this patch using a density sensor.

SUMMARY

Therefore, it is an aspect of the present general inventive concept to provide an image forming apparatus to measure the toner density of a patch pattern formed as a toner image without a deviation in light density, and a control method thereof.

Additional aspects of the general inventive concept will be set forth in part in the description which follows and, in part, will be obvious from the description, or may be learned by practice of the general inventive concept.

Features and/or utilities of the present general inventive concept may be realized by an image forming apparatus including a density sensor including a light emitter to scan light onto at least one patch pattern formed as a toner image and a light receiver to receive light reflected from the at least one patch pattern and to convert the received light to an electrical signal, a switch to turn on or off the light emitter, and a controller to maintain light intensity of the light emitter within a reference range by controlling on-time and off-time of the switch.

The controller may recover the light intensity of the light emitter in each period by controlling a ratio between the on-time and off-time of the switch.

The controller may recover an instant intensity of light emitted from the light emitter to an initial light intensity of the light emitter by controlling the off-time of the switch to be twice as long as the on-time of the switch per period.

A plurality of patch patterns may be formed, and the controller may maintain the light intensity of the light emitter within the reference range by repeatedly turning on and off the switch when a toner density of one of the plurality of patch patterns is measured.

The controller may control the light receiver to receive light reflected from the at least one patch pattern during the on-time of the switch.

The density sensor may detect a toner density of the at least one patch pattern based on an intensity of light reflected from the at least one patch pattern.

The image forming apparatus may further include a digital-to-analog converter to convert a digital signal received from the controller to an analog signal.

The image forming apparatus may further include a constant current driver to output a constant current to the light emitter, and the switch may be installed between the digital-to-analog converter and the constant current driver.

The switch may transmit the analog signal generated from the digital-to-analog converter to the constant current driver or may block supply of the analog signal to the constant current driver.

Features and/or utilities of the present general inventive concept may also be realized by a method to control an image forming apparatus having a density sensor including a light emitter to scan light onto at least one patch pattern formed as a toner image and a light receiver to receive light reflected from the at least one patch pattern and to convert the received light to an electrical signal, the method including scanning light with an intensity within a reference range onto the at least one pattern by controlling on-time and off-time of the light emitter and measuring a toner intensity of the at least one patch pattern based on an intensity of light reflected from the at least one patch pattern.

Light with an intensity within the reference range may be scanned onto the at least one patch pattern by recovering a light intensity of the light emitter in each period by controlling a ratio between the on-time and off-time of the light emitter.

The intensity of light emitted from the light emitter may be recovered by controlling the off-time of the light emitter to be twice as long as the on-time of the light emitter per period.

A plurality of patch patterns may be formed, and the light intensity of the light emitter may be maintained within the reference range by repeatedly turning on and off the light emitter, when a toner density of one of the plurality of patch patterns is measured.

The toner density of the patch pattern may be measured based on the intensity of light received by the light receiver.

The image forming apparatus may further include a switch to turn on or off the light emitter, and the on-time and off-time of the light emitter are controlled by turning on or off the switch.

Features and/or utilities of the present general inventive concept may also be realized by a toner detection apparatus including an emitter to transmit light to a toner patch, a detector to detect light from the emitter reflected off of the patch, and a controller to control the emitter. The controller may maintain a light intensity of the emitter by controlling the durations of the on and off states of the emitter to generate a plurality of periods of the emitter during a toner detection operation of the toner detection apparatus.

The toner detection apparatus may further include a switch, and the controller may turn on and off the emitter by turning on and off the switch.

The toner detection apparatus may further include a constant current driver located between the switch and the emitter to receive a signal from the switch to drive the emitter.

The controller may control the off state of the emitter in a period of the plurality of periods to be at least twice a duration of the on state of the period.

Features and/or utilities of the present general inventive concept may also be realized by an image forming apparatus including at least one image forming unit to form an image based on electrical signals, at least one transfer unit to transfer the formed image to a recording medium by adhering toner to the recording medium, and a toner detection apparatus.

The patch may be formed on one of the image forming unit and the transfer unit.

Features and/or utilities of the present general inventive concept may also be realized by a method of maintaining a light intensity of an emitter to detect toner, the method including turning on the emitter for a first predetermined period of time, detecting light from the emitter reflected off of a toner patch, turning off the emitter for a second predetermined period of time to maintain a light intensity of the emitter within a predetermined reference range, and turning on the emitter after the second predetermined period of time.

BRIEF DESCRIPTION OF THE DRAWINGS

These and/or other aspects of the general inventive concept will become apparent and more readily appreciated from the following description of the embodiments, taken in conjunction with the accompanying drawings of which.

DETAILED DESCRIPTION OF THE EMBODIMENTS

Figure 1:
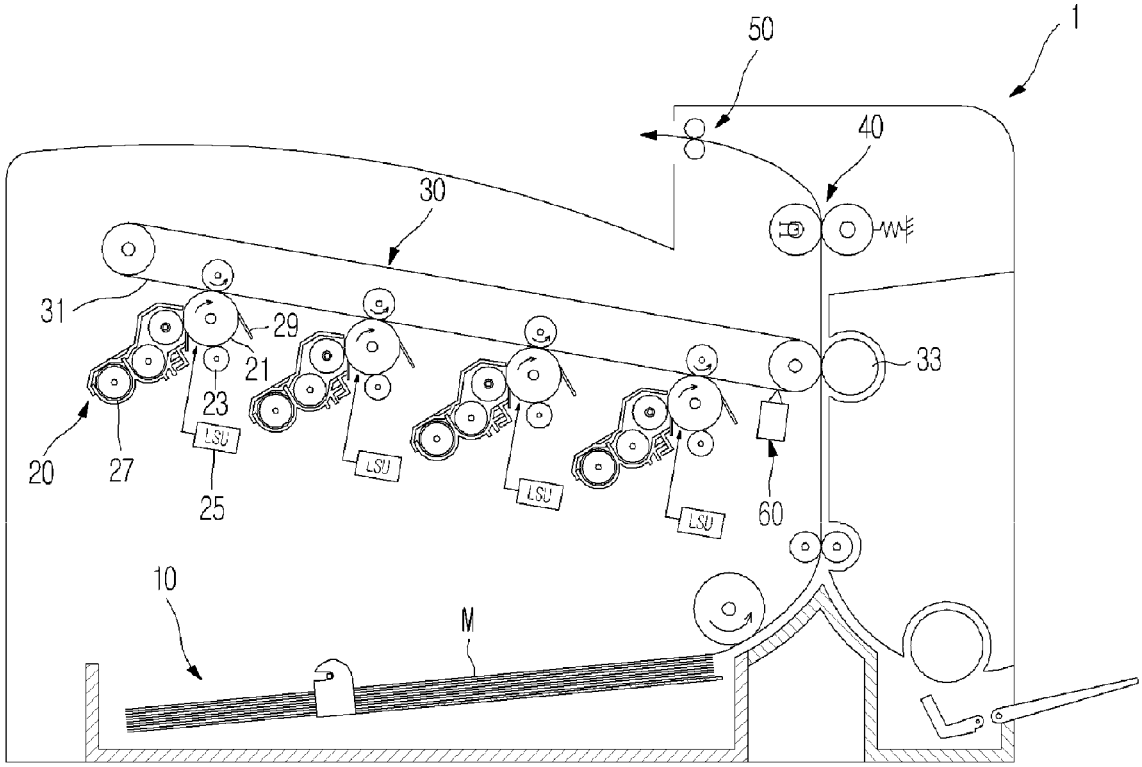
FIG. 1 illustrates an electrophotographic image forming apparatus according to an exemplary embodiment.

Reference will now be made in detail to the embodiments of the present general inventive concept, examples of which are illustrated in the accompanying drawings, wherein like reference numerals refer to like elements throughout.

FIG. 1 illustrates an electrophotographic image forming apparatus according to an exemplary embodiment.

Referring to FIG. 1, an electrophotographic image forming apparatus 1 includes a medium feeder 10 to feed a print medium M, image formers or image forming units 20 to form color images on the print medium M by electrophotography, a transferer or transfer unit 30 to transfer the color images onto the print medium M, a fixer or fusing unit 40 to fix the transferred toner images on the print medium M, and a medium discharger 50 to discharge the print medium M.

Each of the image formers 20 includes a photosensitive medium 21, a charging member 23 to charge the photosensitive medium 21 to a predetermined potential, an exposurer or exposing unit 25 to form an electrostatic latent image on the photosensitive medium 21, a developing device 27 to develop the electrostatic latent image to a visible image on the photosensitive medium 21, and a cleaner 29 to clean excess toner from the photosensitive medium 21 after the visual image is transferred.

The exposing unit 25 includes a Light Scanning Unit (LSU) to scan a light beam onto the photosensitive medium 21 prepared for one of a plurality of colors. The exposing unit 25 forms the electrostatic latent image on the photosensitive medium 21 charged to the predetermined potential by the charging member 23.

The developing device 27 supplies toner to the photosensitive medium 21 in a two-component development scheme and forms the visible image corresponding to the electrostatic latent image. This developing device 27 uses a developer containing a toner that forms an image and a carrier that carries the toner by a magnetic force and forms a toner image on the photosensitive medium 21 by separating the toner from the developer. The amount of toner supplied to the photosensitive medium 21 is affected by the magnitude of a development bias applied to the developing device 27.

The transferer 30 includes an intermediate transfer belt 31 facing a plurality of photosensitive media 21 and a transfer roller 33 facing the intermediate transfer belt 31 with the print medium M transferred along a transfer path between the intermediate transfer belt 31 and the transfer roller 33. Therefore, a visible image formed on each of the plurality of photosensitive media 21 is primarily transferred onto the intermediate transfer belt 31 and then transferred onto the print medium M.

The fixer 40 presses and heats the print medium M as the print medium M passes through the fixer 40, thereby fixing the transferred images on the print medium M.

The image forming apparatus 1 further includes a density detector to detect the toner density of an image to be printed on the print medium M to control the toner density of the image formed on the print medium M. The density detector may include a density sensor 60 which is positioned to face the intermediate transfer belt 31 to sense the toner density of a patch pattern transferred onto the intermediate transfer belt 31. Alternatively, the density detector may be a density sensor 60 which is positioned facing a photosensitive medium 21 to sense the toner density of a patch pattern formed on the photosensitive medium 21.

Figure 2:
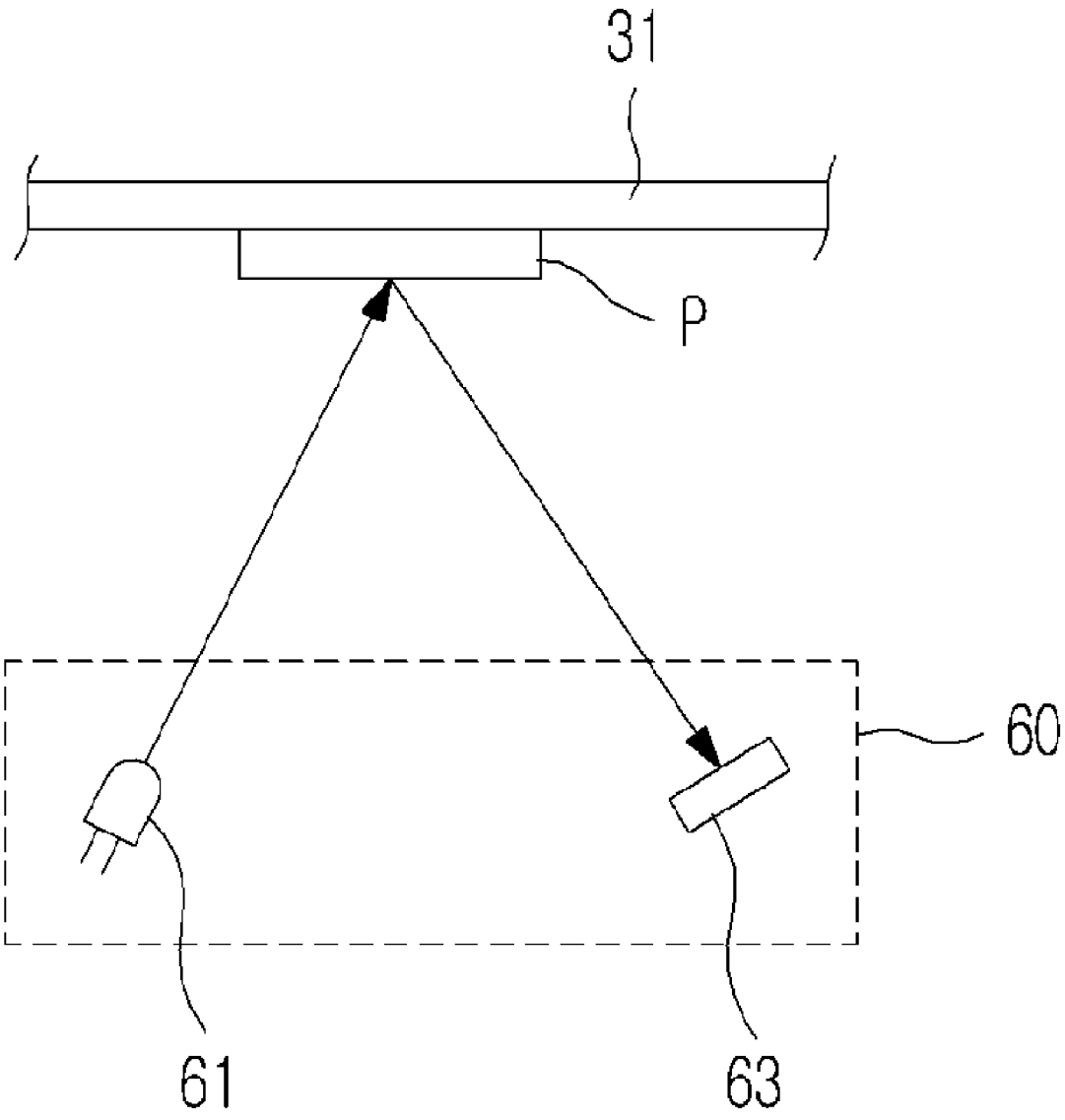
FIG. 2 illustrates a density sensor in the image forming apparatus according to an exemplary embodiment.

FIG. 2 illustrates a density sensor in the image forming apparatus according to an exemplary embodiment.

Referring to FIG. 2, the density sensor 60 includes a light emitter 61 to emit light to the intermediate transfer belt 31 and a light receiver to receive light reflected from the intermediate transfer belt 31 and to convert the received light to an electrical signal. The light emitter 61 may be configured with a Light Emitting Diode (LED) and the light receiver 63 may be configured with a photodiode or a phototransistor.

The density sensor 60 detects the toner density of a patch pattern P formed as a toner image on the intermediate transfer belt 31 based on the intensity of light reflected from the patch pattern P. In general, the patch pattern P is formed when a change has occurred or is expected to occur to a printed result. The patch pattern P may be formed before or after an image forming process occurs, or during printing. The patch pattern P may be formed as an image pattern stored in a body of the image forming apparatus 1, such as in a memory device within the image forming apparatus 1.

Figure 3:
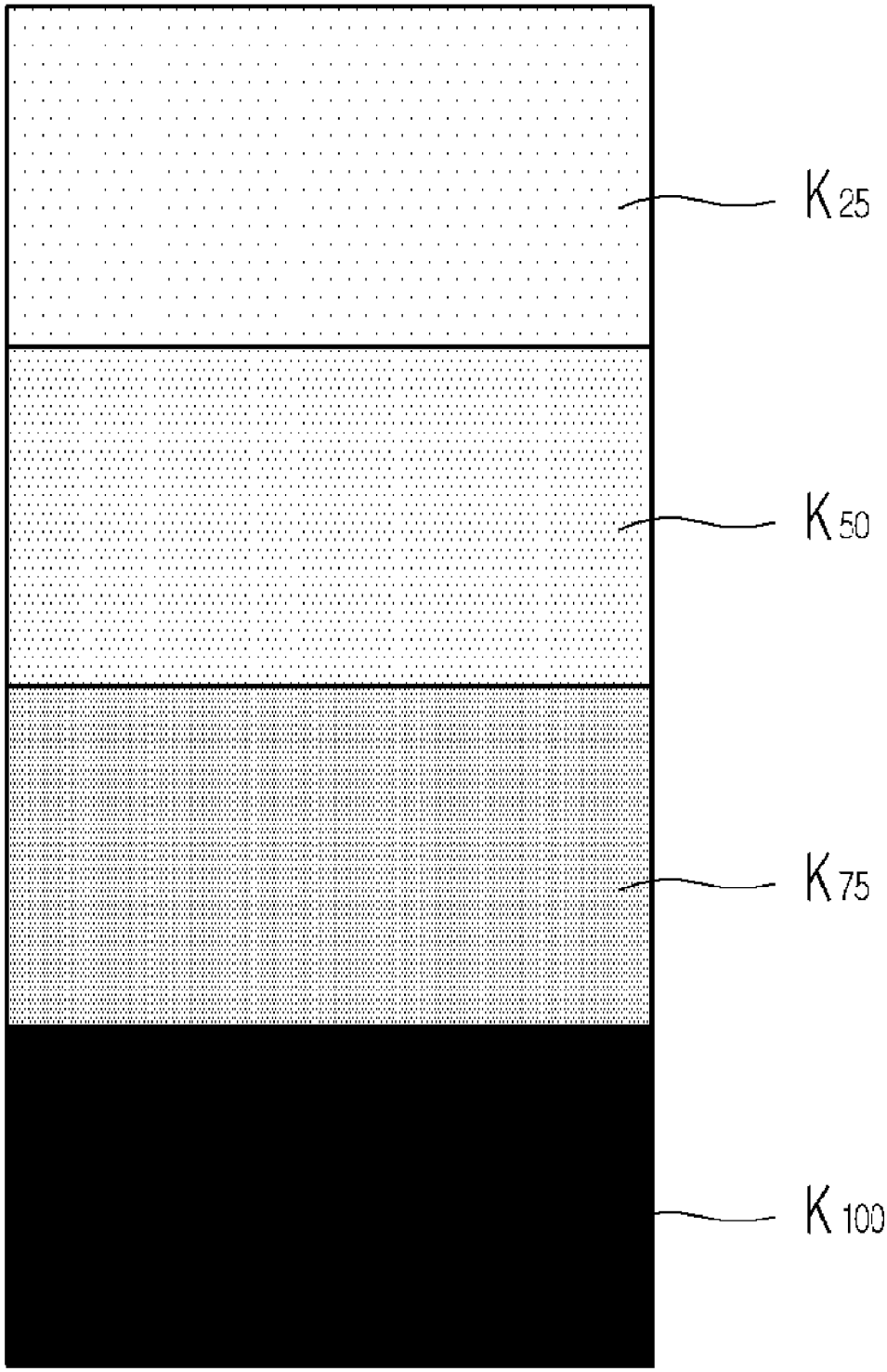
FIG. 3 illustrates an example of patch patterns in the image forming apparatus according to an exemplary embodiment.

FIG. 3 illustrates an example of patch patterns in the image forming apparatus according to an exemplary embodiment.

A plurality of patch patterns P are formed in different colors. Reference characters $K_{25}$, $K_{50}$, $K_{75}$ and $K_{100}$ denote a 25% pattern, a 50% pattern, a 75% pattern and a 100% pattern, respectively. The pattern $K_{100}$ may be used to adjust an image density, whereas the patterns $K_{25}$, $K_{50}$ and $K_{75}$ may be used to adjust gradation characteristics (density steps ranging from a valid highest density area to a valid lowest density area in an image). The density sensor 60 detects the densities of these patch patterns P to adjust an image density or gradation characteristics for each color. When the toner density of one of the patch patterns P is measured, a controller 90 controls a switch 110 to alternate between on and off so that the light intensity of the light emitter 61 is maintained within a reference range, which will be described later in detail.

Figure 4:
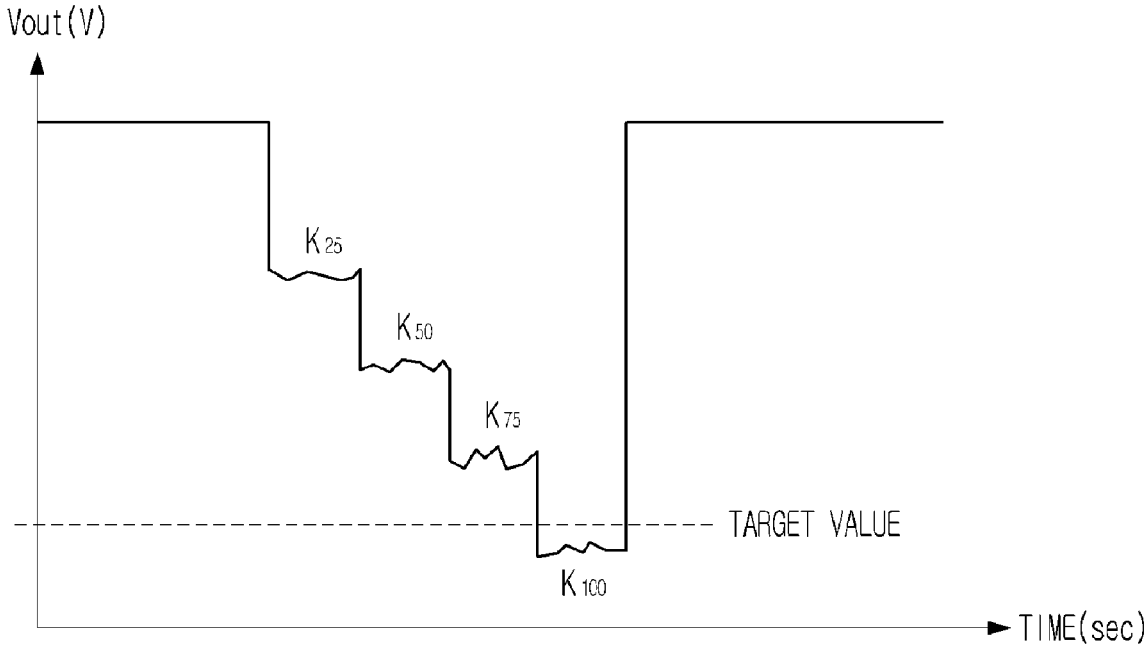
FIG. 4 is a graph illustrating an example of a detected waveform when the toner densities of patch patterns formed on an intermediate transfer belt are detected by the density sensor in the image forming apparatus according to an exemplary embodiment.

FIG. 4 is a graph illustrating an example of a detected waveform when the toner densities of the patch patterns P formed on the intermediate transfer belt are detected by the density sensor 60 in the image forming apparatus according to an exemplary embodiment.

Referring to FIG. 4, an output voltage $V_{out}$ of the light receiver 63 changes according to the patch patterns $K_{25}$ to $K_{100}$. If a developer has a high toner density (a high toner mixing ratio), the amount of attached toner increases and thus the intensity of light reflected from a patch pattern P decreases. As a result, the output voltage $V_{out}$ is decreased. On the other hand, if a developer has a low toner density (a low toner mixing ratio), the amount of attached toner decreases and thus the intensity of light reflected from a patch pattern P increases. As a result, the output voltage $V_{out}$ is increased.

Figure 5A:
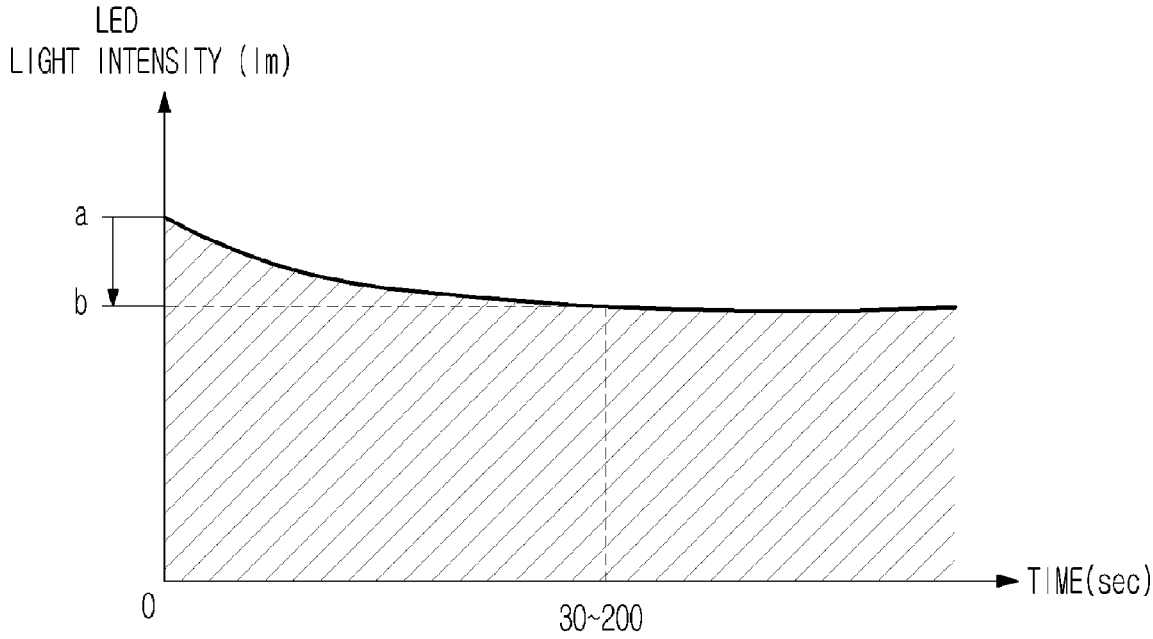
FIG. 5A is a graph illustrating the intensity of light emitted from a light emitter over the on-time of the light emitter according to an exemplary embodiment.
Figure 5B:
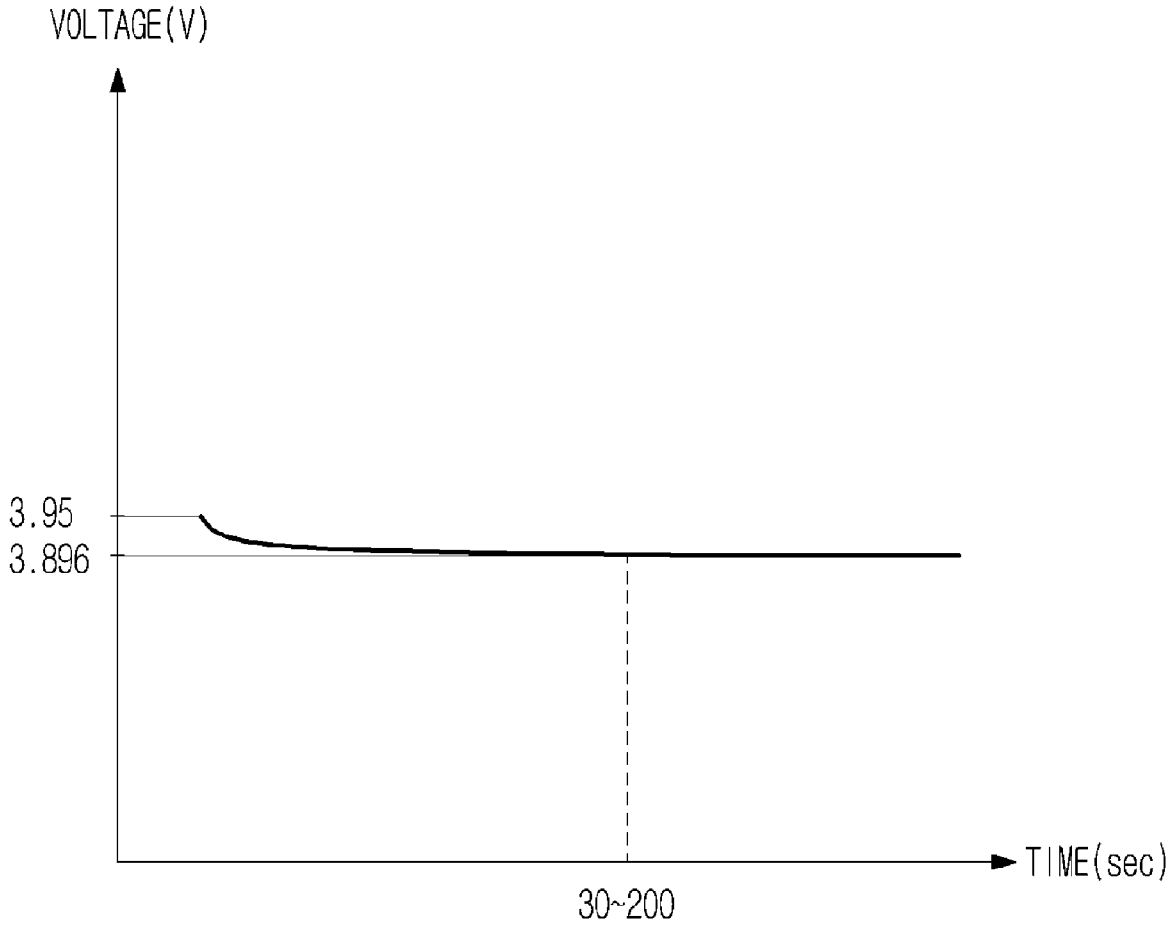
FIG. 5B is a graph illustrating the output voltage of a light receiver over the on-time of the light emitter according to an exemplary embodiment.

FIG. 5A is a graph illustrating the intensity of light emitted from the light emitter over the on-time of the light emitter according to an exemplary embodiment and FIG. 5B is a graph illustrating the output voltage of the light receiver over the on-time of the light emitter according to an exemplary embodiment.

Referring to FIG. 5A, the light intensity of the light emitter 61 decreases for a predetermined time (30 to 200 seconds), when it is driven. If the intensity of initial light emitted from the light emitter 61 is "a" lumens (lm), the light intensity decreases to about "b" lumens (lm) when the predetermined time 30 to 200 seconds elapses although the predetermined time differs with the type of the light emitter. When light reflected from a patch pattern P is received and the toner density of the patch pattern P is measured from the reflected light during the time period in which the light intensity of the light emitter 61 is decreasing, an error is generated.

Referring to FIG. 5B, when the light emitter 61 is driven, an output voltage of the light receiver 63 obtained by opto-electric conversion decreases during the predetermined time 30 to 200 seconds. That is, when the light emitter 61 is initially turned on, the voltage output from the light emitter 63 is 3.95V and 30 to 200 seconds later, the output voltage is decreased to 3.896V.

Figure 6:
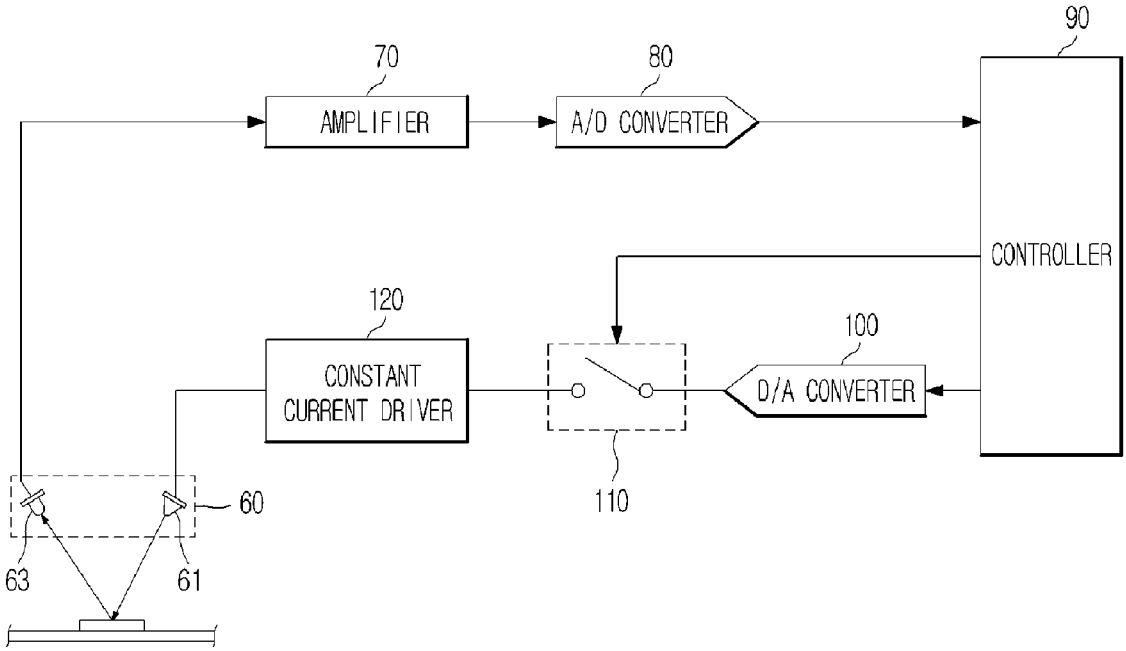
FIG. 6 is a control block diagram of the image forming apparatus according to an exemplary embodiment.

FIG. 6 is a control block diagram of the image forming apparatus according to an exemplary embodiment.

Referring to FIG. 6, the image display apparatus 1 includes the density sensor 60 with the light emitter 61 to scan light onto a patch pattern P formed on the intermediate transfer belt 31 and the light receiver to receive light reflected from the patch pattern P and convert the received light to an electrical signal, an amplifier 70 to amplify the signal received from the light receiver 63, an Analog-to-Digital (A/D) converter 80 to convert the analog signal received from the amplifier 70 to a digital signal, a Digital-to-Analog (D/A) converter 100 to convert a digital signal received from the controller 90 to an analog signal, the switch 110 to switch on or off the signal received from the D/A converter 100, a constant current driver 120 to drive the light emitter 61 of the density sensor 60 by generating a predetermined constant current according to the signal received from the switch 110, and the controller 90 to maintain the intensity of light emitted from the light emitter 61 of the density sensor 60 within a reference range by sensing the toner density of the patch pattern P from the signal received from the light receiver 63 or adjusting the on-time and off-time of the switch 110.

The light emitter 61 of the density sensor 61, which may be configured with an LED, operates at a predetermined time interval according to the on/off of the switch 110. When the light emitter 61 continues emitting light, the temperature of a semiconductor within the LED increases and the intensity of emitted light decreases for a predetermined time after the initial on of the light emitter 61.

The light receiver 63 of the density sensor 60 measures the intensity of light that is emitted from the light emitter 61 and then reflected from the patch pattern P formed as a toner image on the intermediate transfer belt 31.

The switch 110 is interposed between the D/A converter 100 and the constant current driver 120. When the D/A converter 100 generates an analog signal carrying light intensity information, the switch 110 controls the output of the analog signal by switching on/off. Since the switch 110 functions to output the analog signal received from the D/A converter 100 to the constant current driver 120 or block the analog signal from the constant current driver 120, the switch 110 may be an analog switch.

The controller 90 controls the light intensity of the light emitter 61 within a reference range by adjusting the on-time and off-time of the switch 110. The controller 90 turns on the switch 110 for a predetermined time so that the light emitter 61 scans light onto the patch pattern P, and turns off the switch 110 for a predetermined time, thus securing a recovery time during which the light intensity of the light emitter 61 is recovered. Variations in the light intensity of the light emitter 61 with respect to the on-time of the light emitter 61 are listed in Table 1 below. Table 1 lists the decreasing magnitudes of voltages output from the light receiver 63 over time, when the light receiver 63 outputs a voltage of 2000 mV upon the initial on of the light emitter 60.

TABLE 1

| On-time of light emitter (sec) | 2 msec | 0.2 | 2 | 20 | 40 | 200 |
|---|---|---|---|---|---|---|
| Output voltage of light receiver (mV) | 1999 | 1998 | 1973 | 1950 | 1946 | 1935 |
| Decrease of intensity of emitted light (%) | 0.05 or below | 0.1 | 1.35 | 2.5 | 2.7 | 3.25 |

As noted from Table 1, as the on-time of the light emitter 61 in the density sensor 60 increases, the opto-electric converted voltage output from the light receiver 63 decreases. Specifically, the light receiver 63 outputs a voltage proportional to the intensity of light that is emitted from the light emitter 61 and then reflected from a patch pattern. The intensity of light emitted from the light emitter 61 decreases over its on-time. Therefore, the intensity of light reflected from the patch pattern P is decreased and thus the voltage output from the light receiver 63 decreases.

To minimize the change of light intensity over the on-time of the light emitter 61 illustrated in Table 1, the controller 90 shortens the on-time of the light emitter 61 and adjusts the off-time, namely the recovery time of the light emitter 61 during which the intensity of light emitted from the light emitter 61 is recovered, so that the intensity of light reflected from the patch pattern P falls within a reference range. The recovery time of the light emitter 61 will be described with reference with the following table.

TABLE 2

| On-Time of Light Emitter, 100 msec | | | |
|---|---|---|---|
| Off-time/on-time (light emitter) | 1/2 | 1/1 | 2/1 |
| Recovery (%) | 78% | 94% | 100% |

It is noted from Table 2 that when the on-time of the light emitter 61 is twice as long as its off-time in each period, the light intensity of the light emitter 61 is recovered by 78%. In other words, when the on-time of the light emitter 61 is twice as long as its off-time in each period, the intensity of the light emitted from the light emitter 61 is at 78% of the intensity off light emitted from the light emitter 61 when the light emitter first turns on at the beginning of the period. If the on-time is equal to the off-time per period in the light emitter 61, the light intensity of the light emitter 61 is recovered by 94%. If the-off time is twice as long as the on-time of the light emitter 61, the light intensity recovery is 100%.

The controller 90 may control the off-time of the light emitter 61 to be twice as long as the on-time of the light emitter 61 in a period to ensure that the instant intensity of light emitted from the light emitter 61 equals the intensity of light emitted from the light emitter 61 when it is initially turned on at the beginning of the period.

The controller 90 may maintain the light intensity within a reference range by controlling the on-time of the light emitter 61, and the controller 90 may also recover the instant intensity of light emitted from the light emitter 61 to the intensity of light emitted from the light emitter 61 when it is initially on, by controlling the off time of the light emitter 61. Therefore, the controller 90 may output light having an intensity within the reference range by controlling the on-time and off-time of the light emitter 61. Meanwhile, the controller 90 may control the on-time or off-time of the light emitter 61 by controlling the on-time or off-time of the switch 110.

While the switch 110 is on, the controller 90 controls the light receiver 63 to receive light reflected from the patch pattern P. Upon receipt of information about the toner density of the patch pattern P from the density sensor 60, the controller 90 calculates the toner density (% wt) of the developing device 27. If the toner is small in amount, the controller 90 operates a toner supply motor for a predetermined time to thereby supply toner. Then the controller 90 forms a patch pattern P again and determines whether the toner density is appropriate.

Figure 7A:
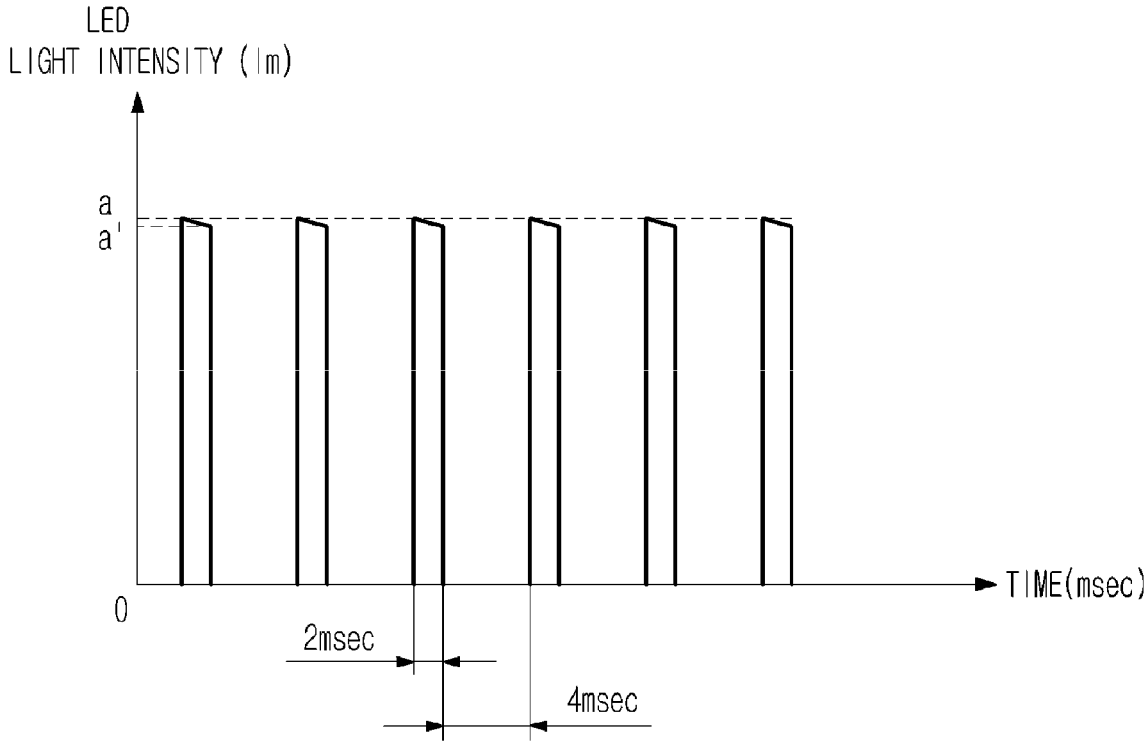
FIG. 7A is a graph illustrating the intensity of light emitted from the light emitter over the on-time of the light emitter according to an exemplary embodiment.
Figure 7B:
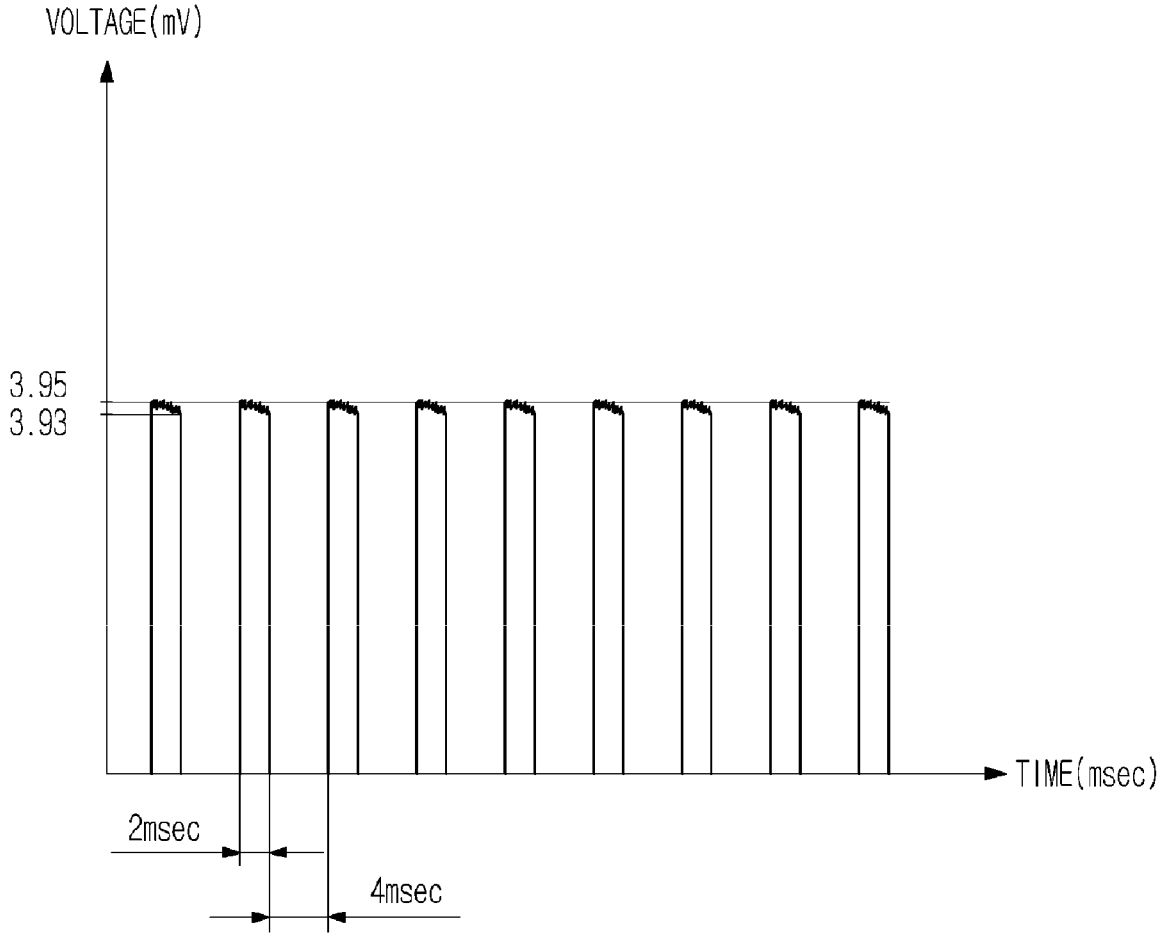
FIG. 7B is a graph illustrating the output voltage off the light receiver over the on-time of the light emitter according to an exemplary embodiment.

FIG. 7A is a graph illustrating the intensity of light emitted from the light emitter over the on-time of the light emitter according to an exemplary embodiment and FIG. 7B is a graph illustrating the voltage output from the light receiver over the on-time of the light emitter according to an exemplary embodiment.

Referring to FIG. 7A, control of the on-time and off-time of the light emitter 61 maintains the intensity of light projected onto the patch pattern P from the light emitter 61 within the reference range. For instance, the light intensity is set to satisfy (a≧light intensity≧a') by controlling the on-time of the light emitter 61 to be 2 msec per period. If the off-time of the light emitter 61 is controlled to be 4 msec per period, the off-time of the light emitter 61 is twice the on-time thereof. Hence, the instant intensity of light emitted from the light emitter 61 is recovered to the intensity of light initially emitted from the light emitter 61.

Referring to FIG. 7B, if the on-time or off-time of the light emitter 61 is adjusted to a predetermined time when it is turned on, the magnitude of an opto-electric converted voltage output from the light receiver 63 is kept almost the same. For example, when the on-time and off-time of the light emitter 61 are controlled to be 2 msec and 4 msec per period, respectively, the difference between the magnitudes of voltages output form the light emitter 61 is little because V1(3.95V)−V2(3.93V)=ΔV(2 mV).

Figure 8:
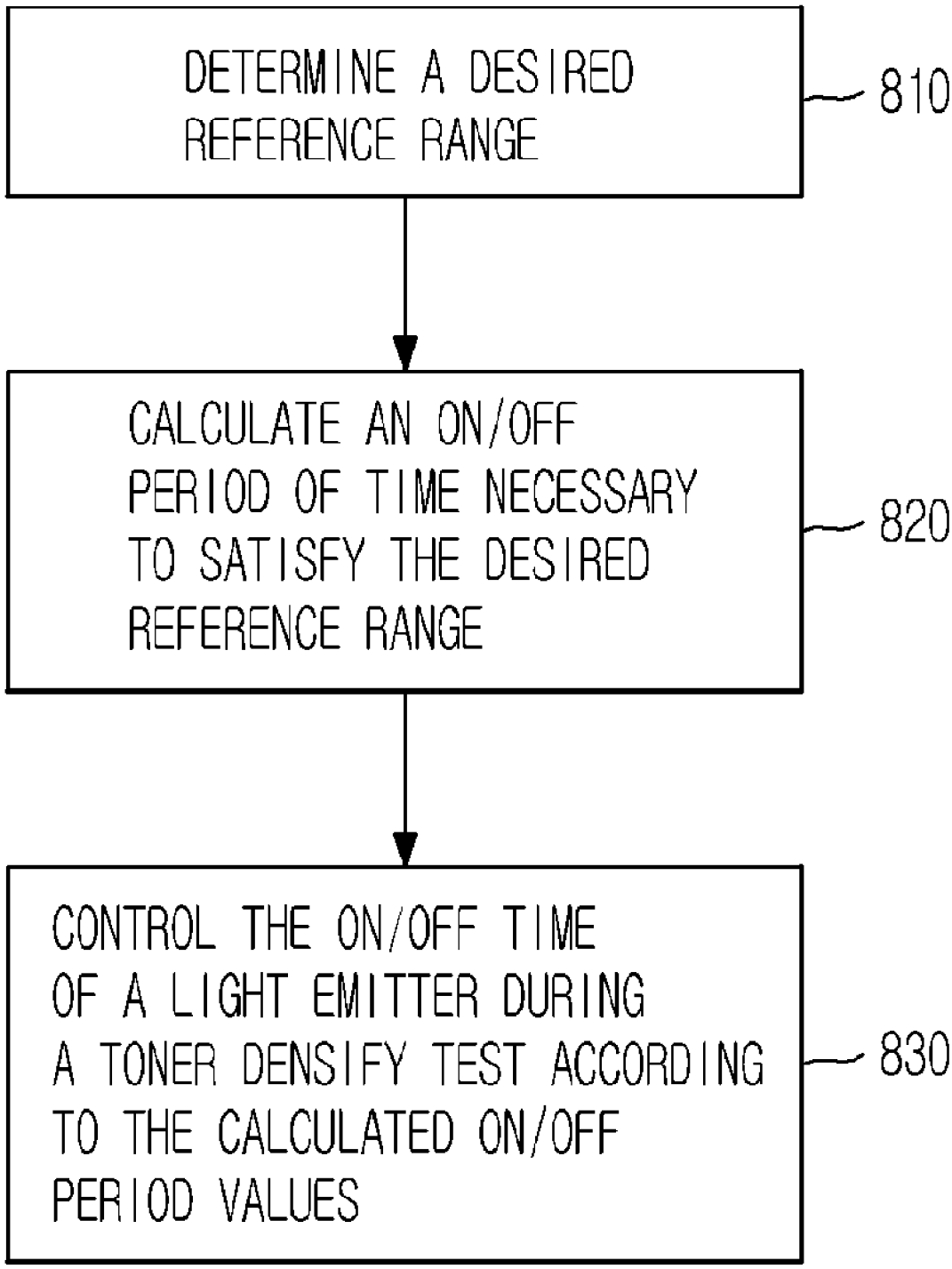
FIG. 8 illustrates a method of selecting an on/off period of an emitter.

FIG. 8 illustrates a method of selecting values to control a light emitter 61. In operation 810, a desired reference range is selected. For example, it may be determined that a light intensity between 84% and 100% of a maximum light intensity is desired, and that an initial light intensity of 94% is acceptable. In operation 820, the on/off duty cycle of the light emitter 61 may be calculated. For example, referring to Table 2, it can be determined that a 1/1 duty cycle may provide a 94% initial light intensity. The time of the on/off states may be calculated to ensure that the light intensity does not drop beneath 84%. For example, as illustrated in FIGS. 5A and 5B, since the diminishing intensity of light output from the light emitter 61 can be observed and measured, the light intensity loss characteristics of a particular light emitter 61 may be used to calculate a voltage value corresponding to 84% of the maximum initial light intensity output. The duration of the on/off cycles may then be calculated to ensure that the light intensity of the light emitter 61 remains above the 84% threshold.

In operation 830, the light emitter 61 may be controlled according to the calculated durations of the on/off states.

Figure 9:
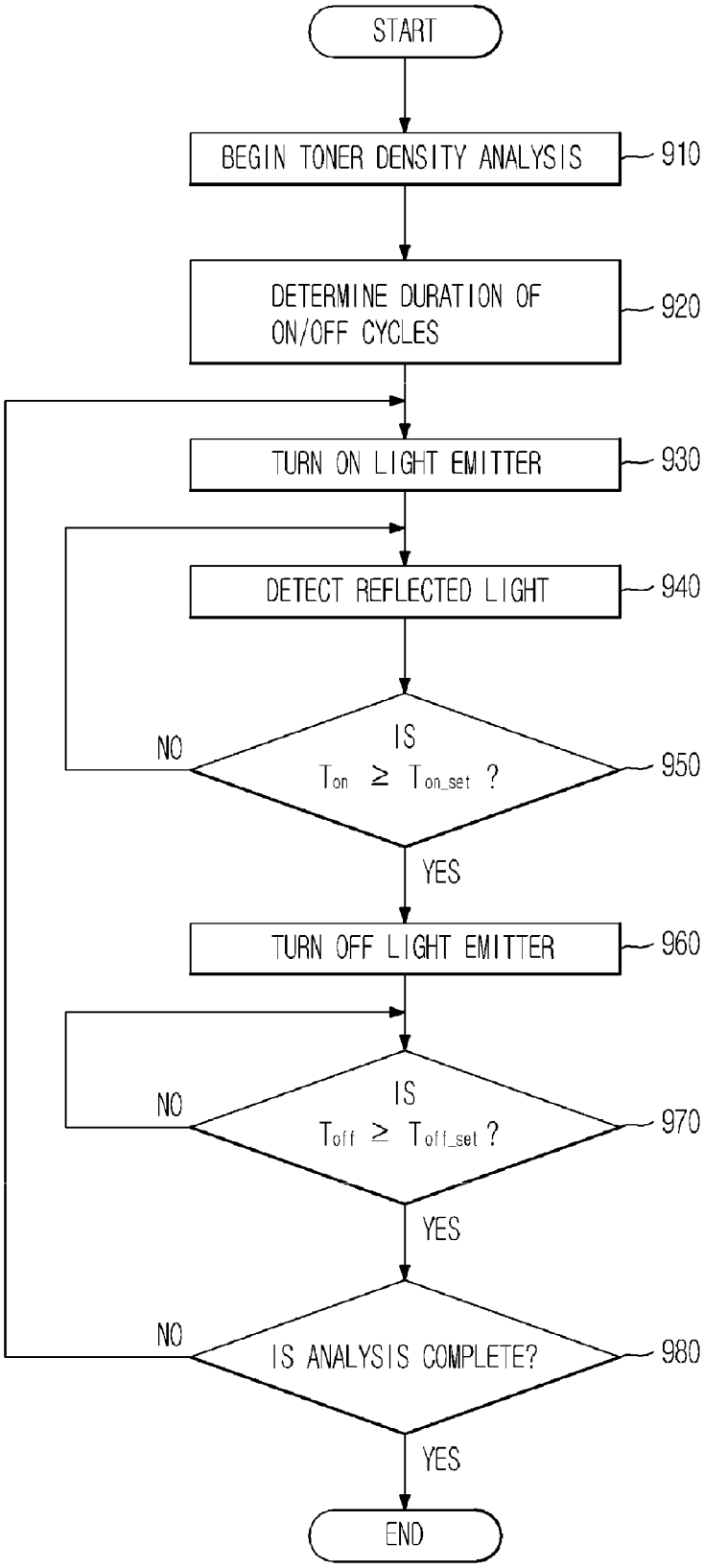
FIG. 9 illustrates a method of controlling the on/off periods of an emitter to maintain a light intensity.

FIG. 9 illustrates a method of controlling the light emitter 61. In operation 910, a command is received to the controller 90 to initiate a toner density analysis. In operation 920, predetermined on/off cycle values are received by the controller 90. In operation 930, the controller 90 controls the light emitter 61 to turn on. The controller 90 may control the light emitter to turn on by controlling a switch 110, for example.

In operation 940, the light reflected from a patch pattern P is detected by the light receiver 63. In operation 950, it is determined whether the light emitter 61 has been on for a period of time $t_{on}$ equal to or greater than a predetermined on time $T_{on_set}$. If not, then the reflected light continues to be detected by the light receiver 63. If $T_{on}$ is greater than or equal to $T_{on_set}$, then the controller 90 turns off the light emitter 61 in operation 960 to begin an off state of the light emitter 61.

In operation 970, it may be determined if the emitter 61 has been off for a period of time $T_{off}$ greater than or equal to a predetermined off state period of time $T_{off_set}$. If so, if not, the light emitter 61 is kept in the off state. However, if $T_{off}$ is greater than or equal to $T_{off_set}$, then it is determined in operation 980 whether the toner density test is complete. If not, the next on/off duty cycle of the light emitter 61 begins and the controller turns on the light emitter 61 in operation 930. Otherwise, the controller 90 leaves the light emitter 61 in the off state and the toner density test ends.

In the above specification and in the claims, a "period" refers to a signal cycle including one "on" or "high" state and one "off" or "low" state. On the other hand, a measure of a length of time may be referred to as a "period of time."

As is apparent from the above description, the image forming apparatus and the control method thereof according to the foregoing exemplary embodiments reduce sensing errors since the toner density of a patch pattern is measured by scanning light within a reference light intensity range onto the patch pattern.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus comprising:

a density sensor comprising:

a light emitter to scan light onto at least one patch pattern of a toner image; and a light receiver to receive light reflected from the at least one patch pattern and to convert the received light to an electrical signal;

a switch to turn on and off the light emitter; and a controller to maintain the light intensity of the light emitter within a reference range by controlling on-time and off-time of the switch, wherein the controller maintains the light intensity of the light emitter within the reference range by repeatedly turning on and off the switch when a toner density of the at least one patch pattern is measured.

2. The image forming apparatus according to claim 1, wherein the controller controls the light intensity of the light emitter in each period by controlling a ratio between the on-time and off-time of the switch.

3. The image forming apparatus according to claim 2, wherein the controller controls the light intensity of light emitted from the light emitter to an initial light intensity of the light emitter by controlling the off-time of the switch to be twice as long as the on-time of the switch per period.

4. The image forming apparatus according to claim 1, wherein the controller controls the light receiver to receive light reflected from the at least one patch pattern during the on-time of the switch.

5. The image forming apparatus according to claim 1, wherein the density sensor detects a toner density of the at least one patch pattern based on an intensity of light reflected from the at least one patch pattern.

6. The image forming apparatus according to claim 1, further comprising a digital-to-analog converter to convert a digital signal received from the controller to an analog signal to output to the switch.

7. The image forming apparatus according to claim 6, further comprising a constant current driver to output a constant current to the light emitter, wherein the switch is installed between the digital-to-analog converter and the constant current driver.

8. The image forming apparatus according to claim 7, wherein the switch transmits the analog signal generated from the digital-to-analog converter to the constant current driver and blocks supply of the analog signal to the constant current driver, respectively.

9. A method to control an image forming apparatus having a density sensor including a light emitter to scan light onto at least one patch pattern formed as a toner image and a light receiver to receive light reflected from the at least one patch pattern and convert the received light to an electrical signal, the method comprising:

scanning light having an intensity within a reference range onto the at least one patch pattern by controlling on-time and off-time of the light emitter; and measuring a toner intensity of the at least one patch pattern based on an intensity of light reflected from the at least one patch pattern, wherein the light intensity of the light emitter is maintained within the reference range by repeatedly turning on and off the light emitter when a toner density of the at least one patch pattern is measured.

10. The method according to claim 9, wherein the light scanning comprises scanning light with an intensity within the reference range onto the at least one patch pattern by recovering a light intensity of the light emitter in each period by controlling a ratio between the on-time and off-time of the light emitter.

11. The method according to claim 10, wherein the intensity of light emitted from the light emitter is recovered by controlling the off-time of the light emitter to be twice as long as the on-time of the light emitter per period.

12. The method according to claim 9, wherein the toner density measuring comprises measuring the toner density of the patch pattern based on the intensity of light received by the light receiver.

13. The method according to claim 9, wherein the image forming apparatus further includes a switch to turn on and off the light emitter, and the on-time and off-time of the light emitter are controlled by turning on or off the switch.

14. A toner detection apparatus, comprising:

an emitter to transmit light to a toner patch;

a detector to detect light from the emitter reflected off of the patch;

a switch to turn on and off the emitter; and a controller to control the emitter to maintain a light intensity of the emitter by controlling the off-time of the light emitter to be twice as long as the on-time of the light emitter, during a period of a toner detection operation of the toner detection apparatus, wherein the controller turns on and off the emitter by repeatedly turning on and off the switch when a toner density of the patch is measured.

15. The toner detection apparatus according to claim 14, further comprising a constant current driver located between the switch and the emitter to receive a signal from the switch to drive the emitter.

16. The toner detection apparatus according to claim 14, wherein the controller controls the off state of the emitter in a period of the plurality of periods to be at least twice a duration of the on state of the period.

17. An image forming apparatus, comprising:

at least one image forming unit to form an image based on electrical signals;

at least one transfer unit to transfer the formed image to a recording medium by adhering toner to the recording medium; and a toner detection apparatus, comprising:

an emitter to transmit light to a toner patch;

a detector to detect light from the emitter reflected off of the patch;

a switch to turn on and off the emitter; and a controller to control the emitter to maintain a light intensity of the emitter by controlling the durations of the on and off states of the emitter to generate a plurality of periods of the emitter during a toner detection operation of the toner detection apparatus, wherein the controller turns on and off the emitter by repeatedly turning on and off the switch when a toner density of the patch is measured.

18. The image forming apparatus according to claim 17, wherein the patch is formed on one of the image forming unit and the transfer unit.

19. A method of maintaining a light intensity of an emitter to detect toner, the method comprising:

turning on the emitter for a first predetermined period of time;

detecting light from the emitter reflected off of a toner patch;

turning off the emitter for a second predetermined period of time to maintain a light intensity of the emitter within a predetermined reference range; and turning on the emitter after the second predetermined period of time, wherein the light intensity of the emitter is maintained within the predetermined reference range by repeatedly turning on and off the emitter when a toner density of the patch pattern is measured.

* * * * *